US009324258B2

(12) United States Patent
Tsuge

(10) Patent No.: US 9,324,258 B2
(45) Date of Patent: Apr. 26, 2016

(54) DISPLAY APPARATUS

(71) Applicant: PANASONIC CORPORATION, Osaka (JP)

(72) Inventor: Hitoshi Tsuge, Osaka (JP)

(73) Assignee: JOLED INC, Tokyo (JP)

( * ) Notice: Subject to any disclaimer, the term of this patent is extended or adjusted under 35 U.S.C. 154(b) by 29 days.

(21) Appl. No.: 13/969,327

(22) Filed: Aug. 16, 2013

(65) Prior Publication Data

US 2013/0335399 A1 Dec. 19, 2013

Related U.S. Application Data

(63) Continuation of application No. PCT/JP2012/005002, filed on Aug. 7, 2012.

(30) Foreign Application Priority Data

Aug. 9, 2011 (JP) ..... 2011-173508

(51) Int. Cl.
*G09G 5/00* (2006.01)
*G09G 3/30* (2006.01)
*G09G 3/32* (2006.01)

(52) U.S. Cl.
CPC ..... *G09G 3/30* (2013.01); *G09G 3/3233* (2013.01); *G09G 3/3291* (2013.01); *G09G 2300/0819* (2013.01); *G09G 2300/0852* (2013.01); *G09G 2300/0861* (2013.01);
(Continued)

(58) Field of Classification Search
CPC ..... G09G 3/30; G09G 3/20
USPC ..... 345/44–82, 204–215
See application file for complete search history.

(56) References Cited

U.S. PATENT DOCUMENTS 6,583,775 B1 6/2003 Sekiya et al.
7,528,812 B2 5/2009 Tsuge et al.
7,619,595 B2 11/2009 Uchino et al.
(Continued)

FOREIGN PATENT DOCUMENTS

CN 1552050 A 12/2004
CN 1855205 A 11/2006
(Continued)

OTHER PUBLICATIONS

International Search Report issued in International Patent Application No. PCT/JP2012/005002 mailed on Nov. 6, 2012.
(Continued)

*Primary Examiner* — Kent Chang
*Assistant Examiner* — Mark Edwards
(74) *Attorney, Agent, or Firm* — McDermott Will & Emery LLP

(57) ABSTRACT

The display apparatus has a plurality of arrayed pixel circuits. Each of the pixel circuits has a current light emitting device; a driving transistor supplying current to the current light emitting device; a first capacitor having a first terminal connected with a gate of the driving transistor; a second capacitor connected between a second terminal of the first capacitor and a source of the driving transistor; a first switch applying a reference voltage to a node at which the first capacitor and the second capacitor are connected; a second switch supplying an image signal voltage to the gate of the driving transistor, and a third switch supplying an initialization voltage to the source of the driving transistor.

16 Claims, 13 Drawing Sheets

(52) U.S. Cl.
CPC . *G09G 2310/0262* (2013.01); *G09G 2310/067* (2013.01); *G09G 2320/043* (2013.01); *G09G 2320/045* (2013.01)

(56) References Cited

U.S. PATENT DOCUMENTS

| | | | | |
|---|---|---|---|---|
| 8,040,363 | B2 | 10/2011 | Park et al. | |
| 8,284,136 | B2 | 10/2012 | Kang et al. | |
| 8,823,606 | B2 | 9/2014 | Takahara et al. | |
| 2002/0047839 | A1 | 4/2002 | Kasai | |
| 2004/0233143 | A1 | 11/2004 | Kasai | |
| 2004/0257353 | A1* | 12/2004 | Imamura et al. | 345/204 |
| 2005/0030264 | A1 | 2/2005 | Tsuge et al. | |
| 2005/0041002 | A1 | 2/2005 | Takahara et al. | |
| 2005/0057580 | A1 | 3/2005 | Yamano et al. | |
| 2005/0269959 | A1* | 12/2005 | Uchino et al. | 315/169.3 |
| 2006/0208971 | A1 | 9/2006 | Deane | |
| 2006/0262109 | A1 | 11/2006 | Park et al. | |
| 2007/0146251 | A1 | 6/2007 | Tsuge et al. | |
| 2008/0224621 | A1 | 9/2008 | Uchino et al. | |
| 2009/0231308 | A1* | 9/2009 | Numao | 345/204 |
| 2010/0309187 | A1* | 12/2010 | Kang et al. | 345/211 |
| 2011/0084947 | A1* | 4/2011 | Chung et al. | 345/211 |
| 2011/0090200 | A1* | 4/2011 | Choi et al. | 345/211 |
| 2011/0164016 | A1 | 7/2011 | Kang et al. | |
| 2014/0333609 | A1 | 11/2014 | Takahara et al. | |

FOREIGN PATENT DOCUMENTS

| | | | |
|---|---|---|---|
| CN | 101266750 | A | 9/2008 |
| JP | 2001-042822 | A | 2/2001 |
| JP | 2001-060076 | A | 3/2001 |
| JP | 2002-169510 | A | 6/2002 |
| JP | 2005-164892 | A | 6/2005 |
| JP | 2005-189695 | A | 7/2005 |
| JP | 2005-345722 | A | 12/2005 |
| JP | 2006-023515 | A | 1/2006 |
| JP | 2006-525539 | A | 11/2006 |
| JP | 2008-051990 | A | 3/2008 |
| JP | 2009-169145 | A | 7/2009 |
| JP | 2010-250260 | A | 11/2010 |
| JP | 2010-282169 | A | 12/2010 |
| KR | 10-2001-0039666 | A | 5/2001 |
| KR | 10-2011-0080388 | A | 7/2011 |
| WO | 2006/103797 | A1 | 10/2006 |

OTHER PUBLICATIONS

Korean Notice of Allowance dated Dec. 26, 2014, issued in corresponding Korean Patent Application No. 10-2013-7025058. 2 pgs.

Chinese Office Action and Search Report issued in Chinese Application No. 201280015964.2 dated Oct. 19, 2015, with English Translation of Search Report.

* cited by examiner

DISPLAY APPARATUS

RELATED APPLICATIONS

This application is the Continuation of International Application No. PCT/JP2012/005002, filed on Aug. 7, 2012, which in turn claims the benefit of Japanese Application No. 2011-173508, filed on Aug. 9, 2011, the disclosures of which Applications are incorporated by reference herein.

TECHNICAL FIELD

The present disclosure relates to an active-matrix display apparatus employing a current light emitting device.

BACKGROUND

An organic EL (electroluminescence) display apparatus has a large number of arrayed self-luminous organic EL devices. The EL display apparatus does not require a backlight and does not have viewing angle restrictions. Accordingly, it has been developed as a next generation display apparatus.

The organic EL device is a current light emitting device which can control luminosity with an amount of current flow. Methods for driving the organic EL device include a simple-matrix method and an active-matrix method. The simple-matrix method needs only a simple pixel circuit but it is difficult to achieve a large-sized and high definition display. For this reason, recently the active-matrix organic EL display apparatus, which employs driving transistors for every pixel circuit, is mainly used.

The driving transistor and the peripheral circuit are formed generally of TFT (Thin Film Transistors) made of poly-silicon or amorphous silicon. Although TFT has the disadvantage of a high threshold voltage fluctuation due to its low mobility, it is suitable for a large-sized organic EL display apparatus because large sized TFT is easy to make and the cost of TFT is low. Further, a method for overcoming the disadvantage (fluctuation of threshold voltage) has been studied by improving a pixel circuit. For example, Patent Literature JP2009-169145A1, describes an organic EL display apparatus which compensates the threshold voltage of the driving transistor.

The compensation of threshold voltage is performed as follows. First, a voltage larger than the threshold voltage is applied between the gate and source of the driving transistor in order to generate current-flow in the transistor and to discharge a capacitor connected between the gate and source of the driving transistor. The current in the driving transistor stops flowing when a terminal to terminal voltage of the capacitor (i.e. voltage between two terminals of the capacitor) decreases to the threshold voltage of the driving transistor. Then, this terminal to terminal voltage is added to an image signal. An image is thereby displayed independently of the threshold voltage of the driving transistor.

If the terminal to terminal voltage of the capacitor is much higher than the threshold voltage, the capacitor is discharged rapidly because the current flowing in the driving transistor is large. However, as the terminal to terminal voltage of capacitor decreases toward the threshold voltage, the amount of the current flowing in the driving transistor decreases. As a result, the discharging speed of capacitor becomes slow. Thus, a long time is required before the terminal to terminal voltage of capacitor falls to the threshold voltage of the driving transistor. Practically, 10-100 micro-seconds, for example, may be required.

However, according to the pixel circuit and the driving method described in the JP2009-169145A1, a data line for supplying an image signal is also used for compensating the threshold voltage. This limits the time available for the writing operation and makes it difficult to achieve a large-sized or high definition display apparatus having a large numbers of pixels.

SUMMARY

The present disclosure relates to a display apparatus having an arrayed pixel circuits, each of the pixel circuits includes:

a current light emitting device;

a driving transistor supplying current to the current light emitting device;

a first capacitor having a first terminal connected with a gate of the driving transistor;

a second capacitor connected between a second terminal of the first capacitor and a source of the driving transistor;

a first switch applying a reference voltage to a node of the first capacitor and the second capacitor to which the first capacitor and the second capacitor are connected;

a second switch supplying an image signal voltage to the gate of the driving transistor;

a third switch supplying an initialization voltage to the source of the driving transistor, and a fourth switch short circuiting the node of the first and second capacitor and the gate of the driving transistor; or applying the reference voltage to the gate of the driving transistor.

Foregoing structure allows achieving writing operation at a high speed, and compensating the threshold value voltage of the driving transistor.

DETAILED DESCRIPTION

The embodiments of a display apparatus of the present disclosure will be described hereafter with reference to the drawings. The present disclosure describes an active-matrix organic EL display apparatus which drives EL devices using a driving transistor, as an example of the display apparatus.

The present disclosure is not limited to the organic EL display apparatus and may be applicable to various active-matrix display apparatus employing an arrayed pixel circuits having a current light emitting device that controls luminosity with an amount of current flow and a driving transistor which supplies current to the current light emitting device.

First Embodiment

Figure 1:
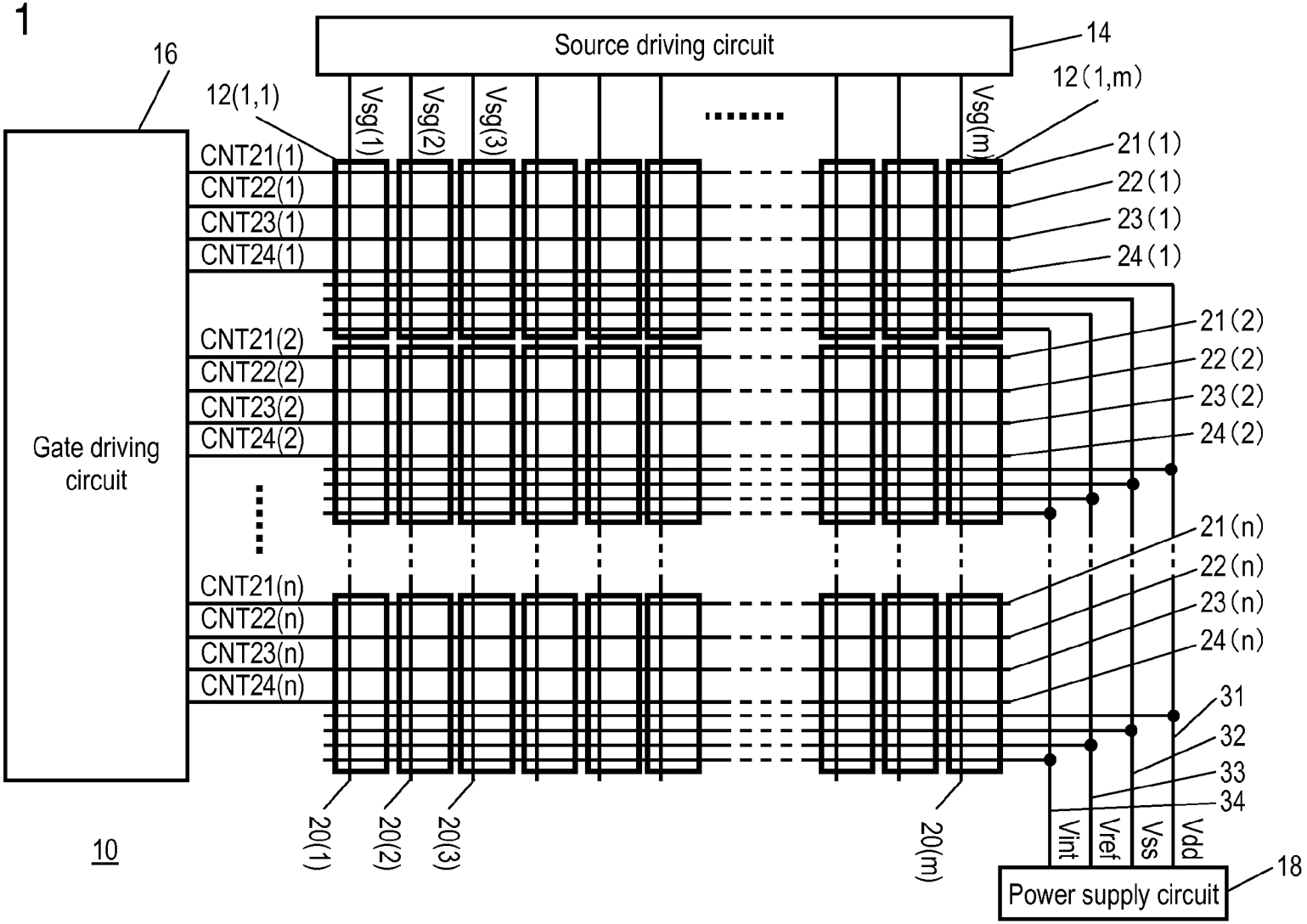
FIG. 1 is a block diagram illustrating a structure of the display apparatus according to a first embodiment.

FIG. 1 is a block diagram illustrating a structure of display apparatus 10 according to the first embodiment. Display apparatus 10 has a large number of arrayed (n-rows, m-column) pixel circuits 12 (i, j) (1<=i<=n and 1<=j<=m), source driving circuit 14, gate driving circuit 16, and power supply circuit 18.

As shown in FIG. 1, source driving circuit 14 supplies image signal voltage Vsg (j) to each of data lines 20 (j) that is connected commonly to pixel circuits 12 (1, j) to 12 (n, j) (j represents each of the pixel columns 1 to m, m being the highest number). The pixel circuits 12 (1, j) to 12 (n, j) are aligned in column. Gate driving circuit 16 supplies control signals CNT21 (i), CNT22 (i), CNT25 (i), CNT26 (i), CNT27 (i) to control signal lines 21(i), 22(i), 25(i), 26(i), 27(i) which are connected commonly to pixel circuits 12 (i, 1) to 12 (i, m) (i represents each of the pixel rows 1 to n, n being the highest number). The pixel circuits 12 (i, 1) to 12 (i, m) are aligned in row direction. In this embodiment, four kinds of control signals CNT21 (i) to CNT24 (i) are supplied to one pixel circuit 12 (i, j). However, the number of control signals is not limited to four.

Power supply circuit 18 supplies the high-voltage Vdd to power source lines 31 and the low-voltage Vss to power source lines 32. These power source lines are connected to all pixel circuits 12 (1, 1) to 12 (n, m). The voltages Vdd and Vss are provided so that the organic EL device, which is described later, can emit light. Reference voltage Vref is supplied to voltage line 33 which are connected to all of pixel circuits 12 (i, j). Initialization voltage Vint is supplied to voltage line 34 which are also connected to all of pixel circuits 12 (i, j).

Figure 2:
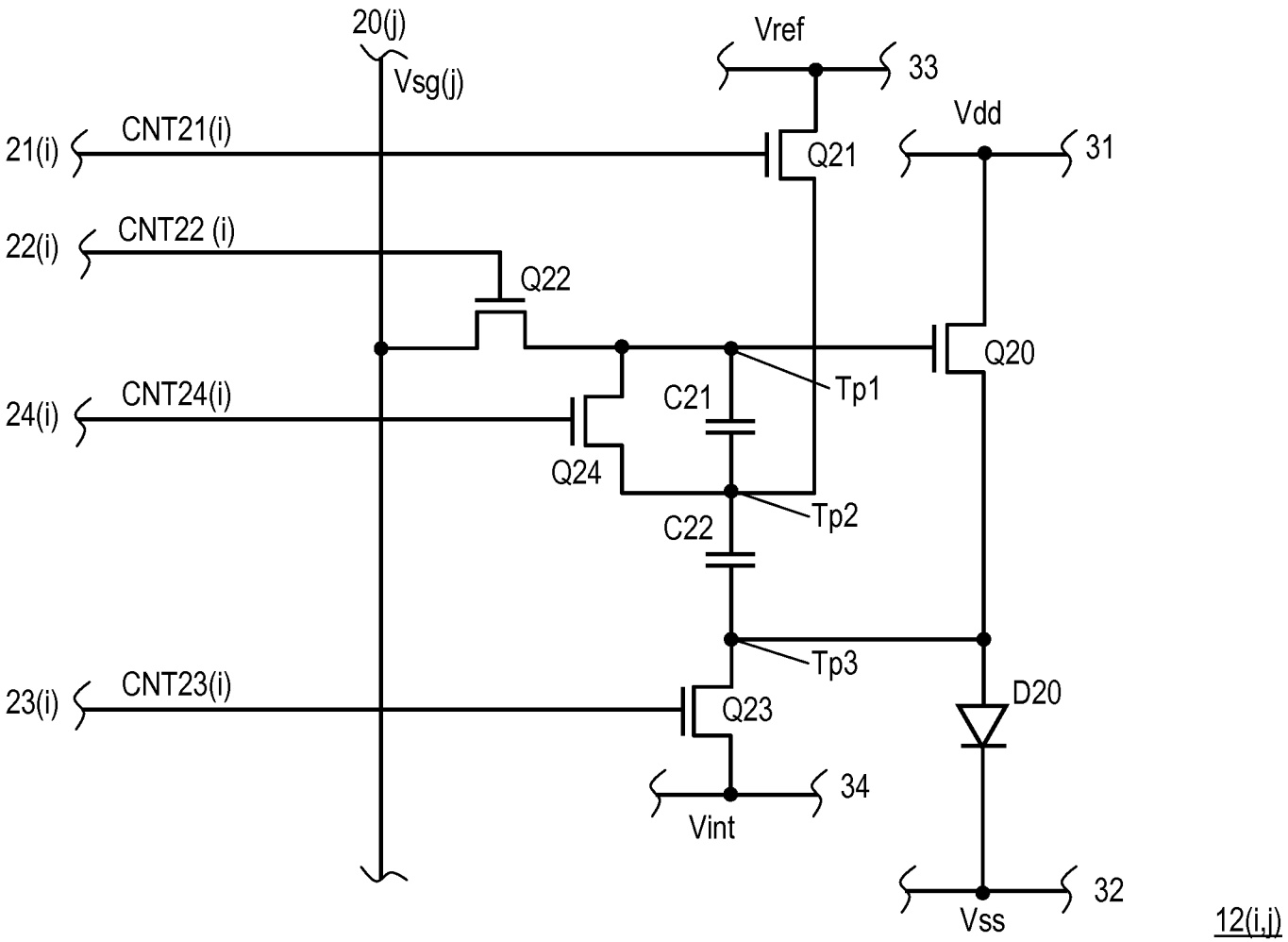
FIG. 2 is a circuit diagram of a pixel circuit of the display apparatus.

FIG. 2 is a circuit diagram of pixel circuit 12 (i, j) of display apparatus 10 of the first embodiment. Pixel circuit 12 (i, j) has organic EL device D20 (an example of a current light emitting device), driving transistor Q20, first capacitor C21, second capacitor C22, and transistors Q21 to Q24 which operate as switches.

Driving transistor Q20 supplies current to organic EL device D20. First capacitor C21 stores image signal voltage Vsg which varies in response to image signal (j). Transistor Q22 is a switch for writing (charging) image signal voltage Vsg (i) to first capacitor C21. Second capacitor C22 stores threshold voltage Vth of driving transistor Q20. Transistor Q21 is a switch for applying reference voltage Vref to one terminal of first capacitor C21. Transistor Q23 is a switch for applying initialization voltage Vint to one terminal of second capacitor C22.

All of driving transistor Q20 and transistors Q21 to Q24 are N-channel TFT (Thin Film Transistors) and enhancement type transistors. However, present disclosure is not limited to such a configuration.

Pixel circuit 12 (i, j) has a structure that driving transistor Q20 and organic EL device D20 are connected between power source lines 31 and 32. To be specific, a drain of driving transistor Q20 is connected to power source line 31, a source of driving transistor Q20 is connected to an anode of organic EL device D20, and a cathode of organic EL device D20 is connected to power source line 32.

First capacitor C21 and second capacitor C22 are connected in series between a gate and source of driving transistor Q20. That is, one terminal (first terminal) of first capacitor C21 is connected to the gate of driving transistor Q20, and second capacitor C22 is connected between the other terminal (a second terminal) of first capacitor C21 and the source of driving transistor Q20. Hereafter, a node to which the gate of driving transistor Q20 and first capacitor C21 are connected is called "node Tp1". A node to which first capacitor C21 and second capacitor C22 are connected is called "node Tp2". A node to which second capacitor C22 and the source of transistor Q20 are connected is called "node Tp3".

A drain of transistor Q21 (first switch) is connected to voltage line 33 which supplies reference voltage Vref. A source of transistor Q21 is connected to node Tp2. A gate of transistor Q21 is connected to control signal line 21(i). Transistor Q21 thereby applies reference voltage Vref to node Tp2. Transistor Q21 may be a P-channel TFT instead of the N-channel TFT. When the transistor is P-channel TFT, the positions of the gate and source are reverse to that of the N-channel TFT. The same can be applied to the transistors (Q22, Q23, Q24) described below.

A drain of transistor Q22 (second switch) is connected to node Tp1. A source of transistor Q22 is connected to data line 20(j) which supplies image signal voltage Vsg. A gate of transistor Q22 is connected to control signal line 22(i). Transistor Q22 thereby supplies image signal voltage Vsg to the gate of driving transistor Q20.

A drain of transistor Q23 (third switch) is connected to node Tp3. A source of transistor Q23 is connected to voltage line 34 which supplies initialization voltage Vint. A gate of transistor Q23 is connected to control signal line 23(i). Transistor Q23 thereby supplies initialization voltage Vint to the source of driving transistor Q20.

A drain of transistor Q24 (fourth switch) is connected to node Tp1. A source of transistor Q24 is connected to node Tp2. A gate of transistor Q24 is connected to control signal line 24(i). Transistor Q24 thereby short-circuits node Tp2 and the gate of driving transistor Q20.

Here, each of control signals CNT21(i) to CNT24(i) is supplied respectively to each of control signal lines 21(i) to 24(i).

As described above, pixel circuit 12 (i, j) in this embodiment includes:

first capacitor C21 having a first terminal connected to a gate of driving transistor Q20;

second capacitor C22 connected between a second terminal of first capacitor C21 and a source of driving transistor Q20;

transistor Q21 (first switch) supplying reference voltage Vref to node Tp2 of the capacitors C21 and C22;

transistor Q22 (second switch) applying image signal voltage Vsg to the gate of driving transistor Q20;

transistor Q23 (third switch) supplying initialization voltage Vint to the source of driving transistor Q20, and transistor Q24 (fourth switch) short-circuiting node Tp2 and the gate of driving transistor Q20.

In this embodiment, the minimum voltage between anode and cathode for supplying current in organic EL device D20 is 1(V)(this minimum voltage is called Vled hereafter). The capacity between anode and cathode when current does not flow in the organic EL device D20 is 1 (pF). Threshold voltage Vth of driving transistor Q20 is about 1.5(V). The electric capacity of first capacitor C21 and second capacitor C22 is 0.5 (pF). Regarding to the driving voltage, high-voltage Vdd is 10(V), low-voltage Vss is 0(V), reference voltage Vref is 1(V), and initialization voltage Vint is −1(V). However, these values may change according to the specification of the display apparatus or characteristic of each device. Thus, it is desirable to set the driving voltage optimally according to the specification of the display apparatus or characteristic of the devices.

Figure 3:
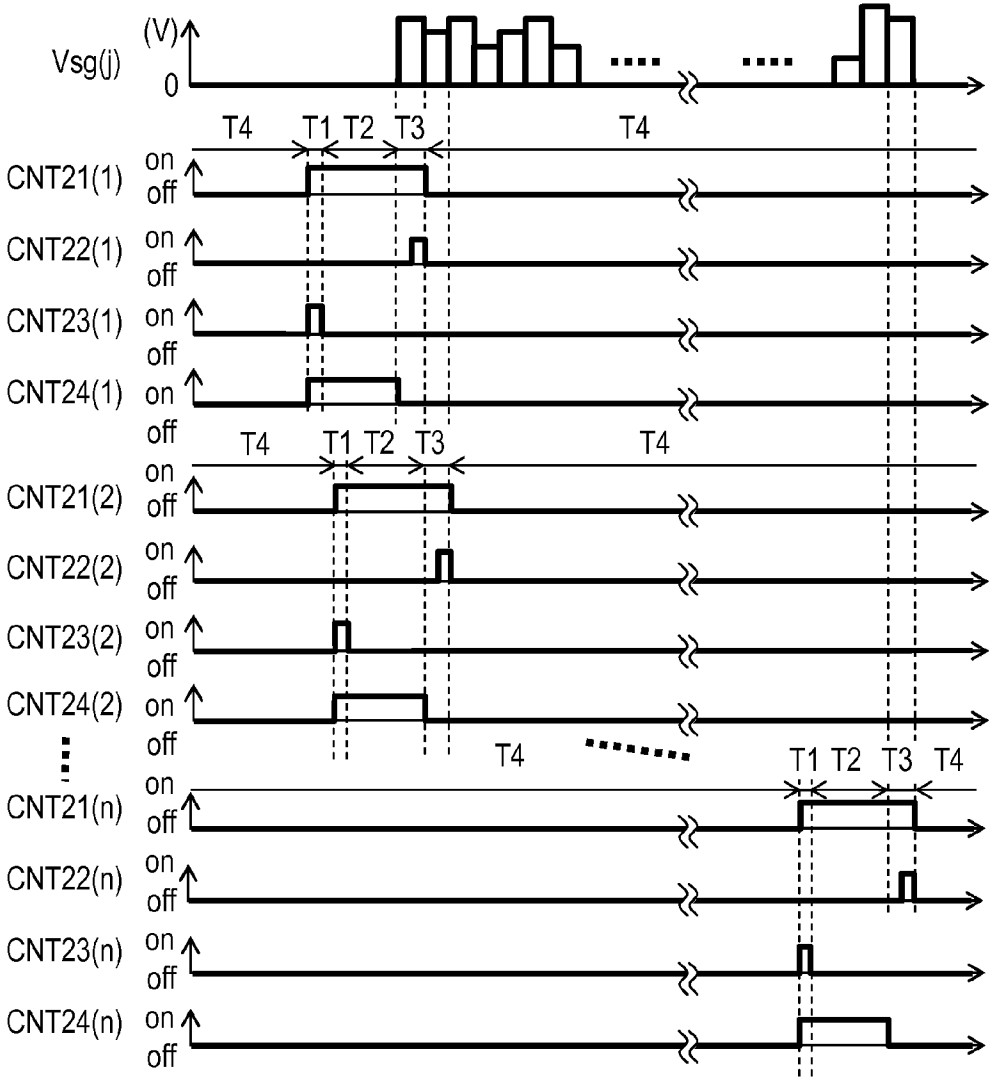
FIG. 3 is a timing diagram illustrating an operation of the display apparatus.

Next, the operation of pixel circuit 12 (i, j) according to this embodiment is described. FIG. 3 is a timing diagram illustrating an operation of display apparatus 10 of the first embodiment.

As shown in FIG. 3, one frame period is divided into four periods (i.e. initialization period T1, threshold detecting period T2, writing period T3, and luminescence period T4) in order to control organic EL device D20 included in each of the pixel circuits 12 (i, j).

In initialization period T1, second capacitor C22 is charged to a predetermined voltage.

In threshold detecting period T2, threshold voltage Vth of driving transistor Q20 is detected.

In writing period T3, image signal voltage Vsg, which varies in response to image signal (j), is written (charged) to first capacitor C21.

In luminescence period T4, a sum of terminal to terminal voltages of first capacitor C21 and second capacitor C22 is applied between the gate and source of driving transistor Q20. This leads to generate a current-flow in organic EL device D20 so that the device D20 can emit light.

The timings of these four periods are set to same so that the pixel circuits belonging in the same row (i.e. pixel circuits 12 (i, 1) to 12 (i, m)) operates with same timings. Meanwhile, the timings of writing periods T3 are set so that the periods T3 in the different rows do not overlap each other. Accordingly, while a writing operation is being performed on one pixel row, the other pixel rows can execute an operation other than the writing. Thus, driving period can be used efficiently.

Figure 4:
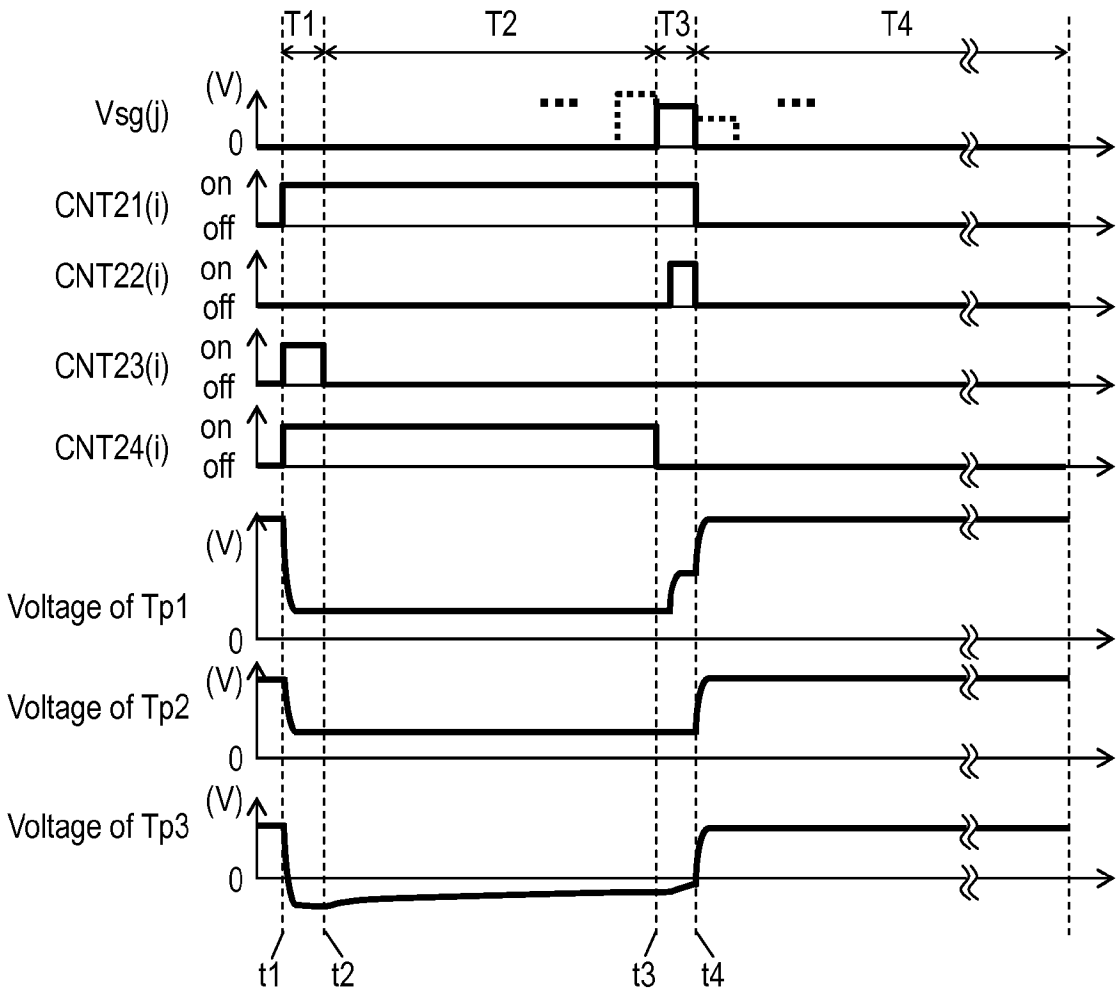
FIG. 4 is a timing diagram illustrating an operation of the pixel circuit of the display apparatus.

FIG. 4 is a timing diagram illustrating an operation of pixel circuit 12 (i, j) of display apparatus 10 according to the first embodiment. In FIG. 4, changes of the voltages in nodes Tp1 to Tp3 are also illustrated. Hereafter, operation of pixel circuit 12 (i, j) is detailed for each of the divided period.

Initialization Period T1

Figure 5:
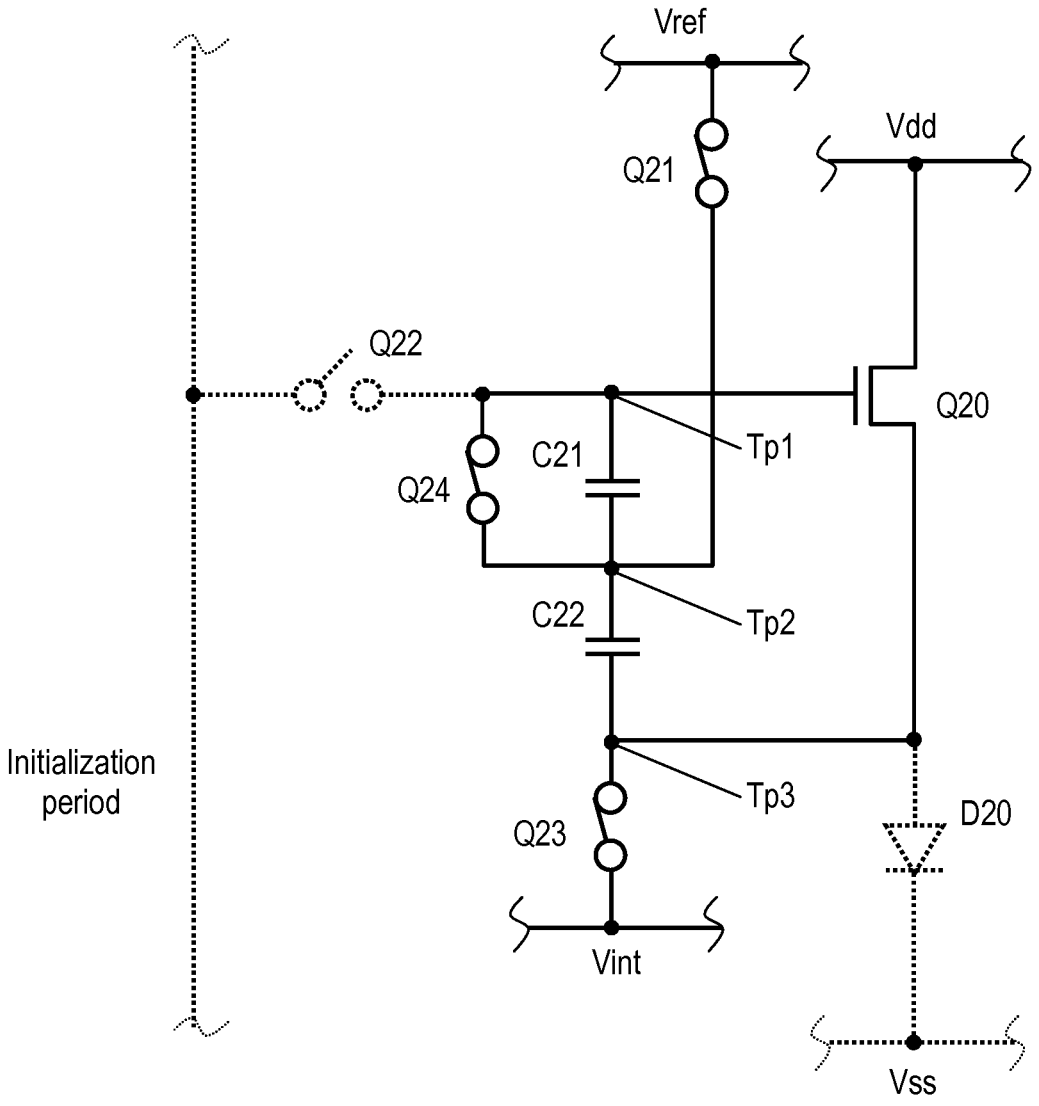
FIG. 5 is a circuit diagram for illustrating an operation of the pixel circuit during the initialization period.

FIG. 5 is a circuit diagram for illustrating an operation of pixel circuit 12 (i, j) during initialization period T1. In FIG. 5, transistors Q21 to Q24 (of FIG. 2) are shown by symbols of switches. The path through which current does not flow is shown in dotted line.

At time t1, while control signal CNT22(i) is set to low level to set transistor Q22 OFF, control signals CNT21(i), CNT23 (i), and CNT24 (i) are set to high level to set transistors Q21, Q23, and Q24 ON. Reference voltage Vref is thereby applied to node Tp2 via transistor Q21, and to node Tp1 via transistor Q24. Initialization voltage Vint is applied to node Tp3 via transistor Q23.

Reference voltage Vref is set to a voltage lower than a sum of low-voltage Vss and voltage Vled, i.e. Vref<Vss+Vled. Accordingly, organic EL device D20 does not emit light during initialization period T1 because source voltage of driving transistor Q20 is lower than voltage (Vss+Vled).

Initialization voltage Vint is set to a voltage such that the difference from reference voltage Vref is larger than threshold voltage Vth of driving transistor Q20. When transistors Q21, Q24 and Q23 are turned ON, voltage Vref is applied to first terminal, and voltage Vint is applied to the second terminal of second capacitor C22. That is, voltage (Vref−Vint) is charged to second capacitor C22. Accordingly, the voltage (Vref−Vint) is also charged between the gate and source of driving transistor Q20. Since the voltage (Vref−Vint) is higher than the threshold voltage Vth of the driving transistor, as derived from the Condition 2, a current is supplied from the power supply of high-voltage Vdd to the power supply of initialization voltage Vint via driving transistor Q20 and transistor Q23.

In this embodiment, initialization period T1 is set to 1 micro second.

Threshold Detection Period T2

Figure 6:
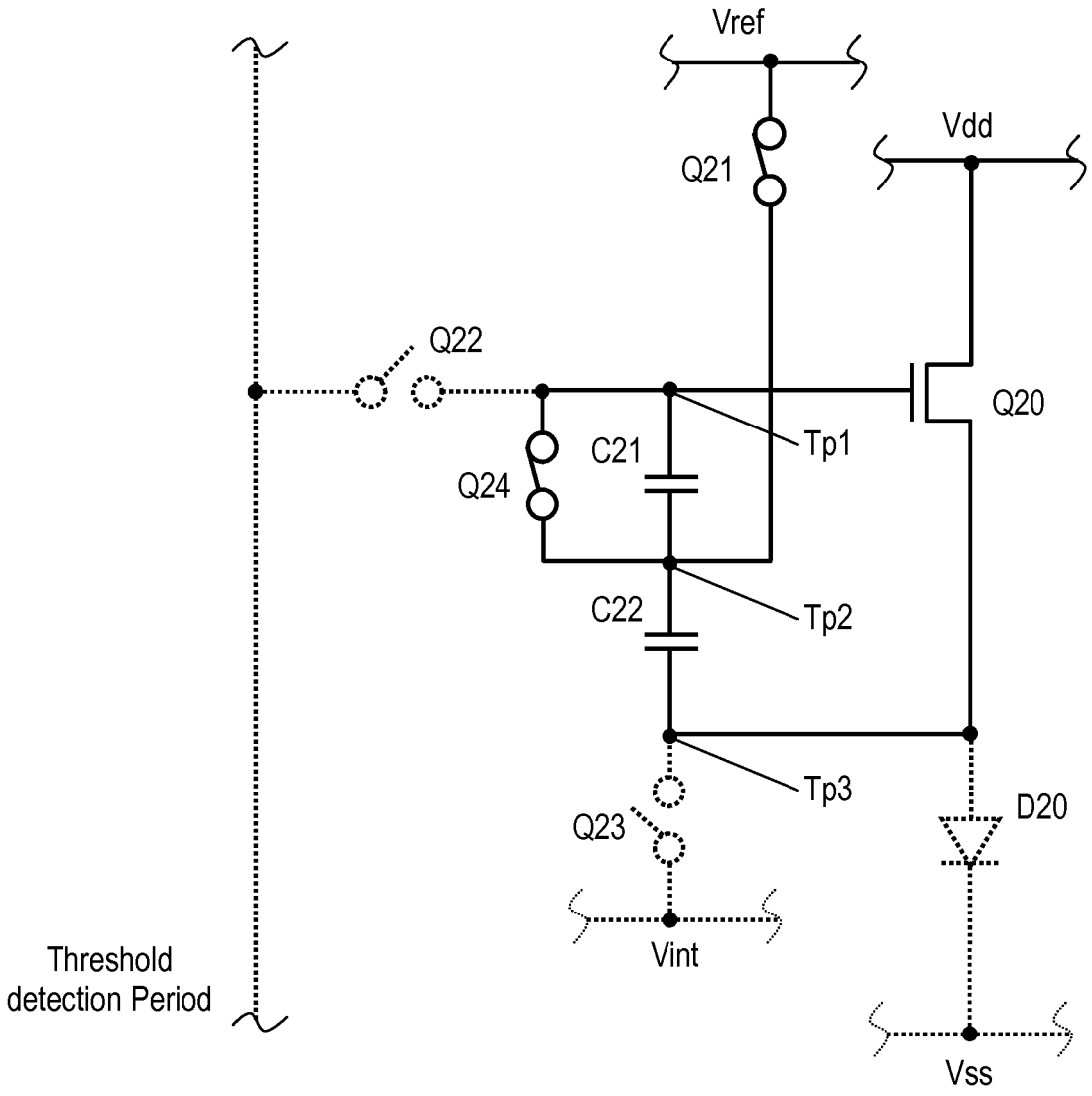
FIG. 6 is a circuit diagram for illustrating an operation of the pixel circuit during the threshold detecting period.

FIG. 6 is a circuit diagram for illustrating an operation during threshold detection period T2 in pixel circuit 12 (i, j) of the first embodiment.

At time t2, control signal CNT23(i) is set to low level to set transistor Q23 OFF. At this point, current flows continuously in driving transistor Q20 because the terminal to terminal voltage of second capacitor C22 (this terminal to terminal voltage is referred to as voltage V22 hereafter) is applied between the gate and source of driving transistor Q20. Due to this current, second capacitor C22 is discharged and voltage V22 starts decreasing.

While the voltage V22 is higher than threshold voltage Vth, current keeps flowing although the amount of the current continues to decrease in driving transistor Q20. Voltage V22 thereby decreases gradually to threshold voltage Vth. When the voltage V22 falls to threshold voltage Vth, the current in driving transistor Q20 stops flowing. The voltage V22 also stops decreasing.

The current flowing in driving transistor Q20 decreases as the voltage V22 decreases because the driving transistor Q20 operates as a current source which is controlled by the voltage applied between the gate and source of driving transistor Q20 (this voltage is referred to as "G-S voltage" hereafter). As a result, a long time is required before voltage V22 falls to threshold voltage Vth. Moreover, the long time requirement is further caused because the large electric capacity of organic EL device D20 is added to the electric capacity of second capacitor C22. Practically, this takes 10 to 100 times longer than the case of discharging the capacitor by transistor-switching. For this reason, threshold detection period T2 is set to 10 micro seconds in this embodiment.

Writing Period T3

Figure 7:
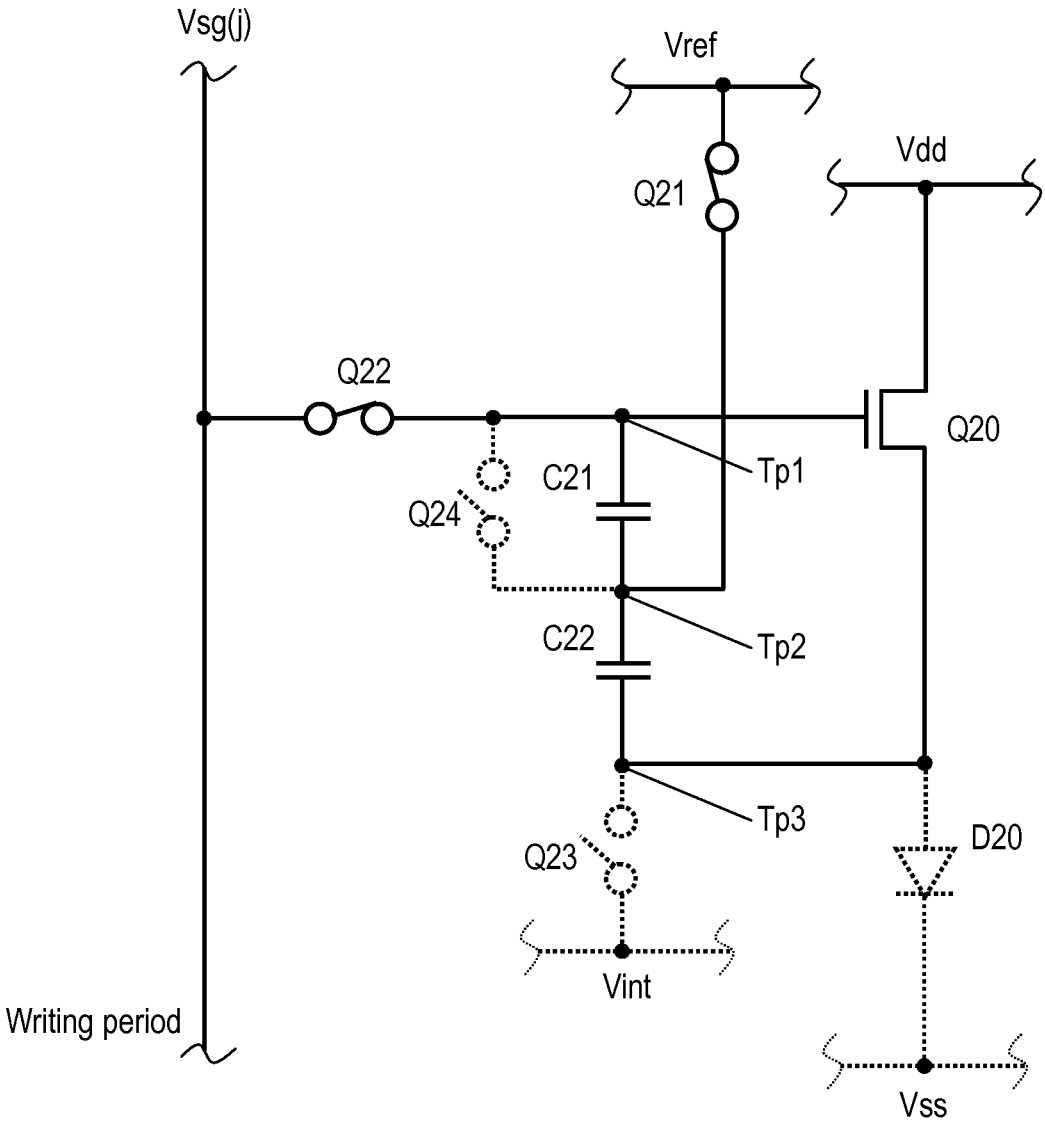
FIG. 7 is a circuit diagram for illustrating an operation of the pixel circuit during the writing period.

FIG. 7 is a circuit diagram for illustrating an operation of pixel circuit 12 (i, j) during writing period T3 according to the first embodiment.

At time t3, control signal CNT24(i) is set to low level to set transistor Q24 OFF. Then, control signal CNT22(i) is set to high level to set transistor Q22 ON. As a result, the voltage of node Tp1 turns to image signal voltage Vsg (j), and voltage (Vref−Vsg) is charged between two terminals of first capacitor C21. Hereafter, this voltage (Vref−Vsg) is referred to as image signal voltage Vsg'.

At this point, voltage (Vsg'+Vth) is applied between the gate and source of driving transistor Q20. This voltage is equivalent to a sum of the voltages charged in the first capacitor C21 and the second capacitor C22 (i.e. image signal voltage Vsg' is charged to the capacitor C21; and threshold voltage Vth is charged to the capacitor C22). While image signal voltage Vsg' is larger than zero, current flows in driving transistor Q20 because the voltage applied between the gate and source of driving transistor Q20 is higher than threshold voltage Vth of the transistor Q20. Due to this current, the voltage V22 decreases. However, the decrease in voltage V22 is only a little because writing period T3 is set to very short time (less than 1 micro second).

Luminescence Period T4

Figure 8:
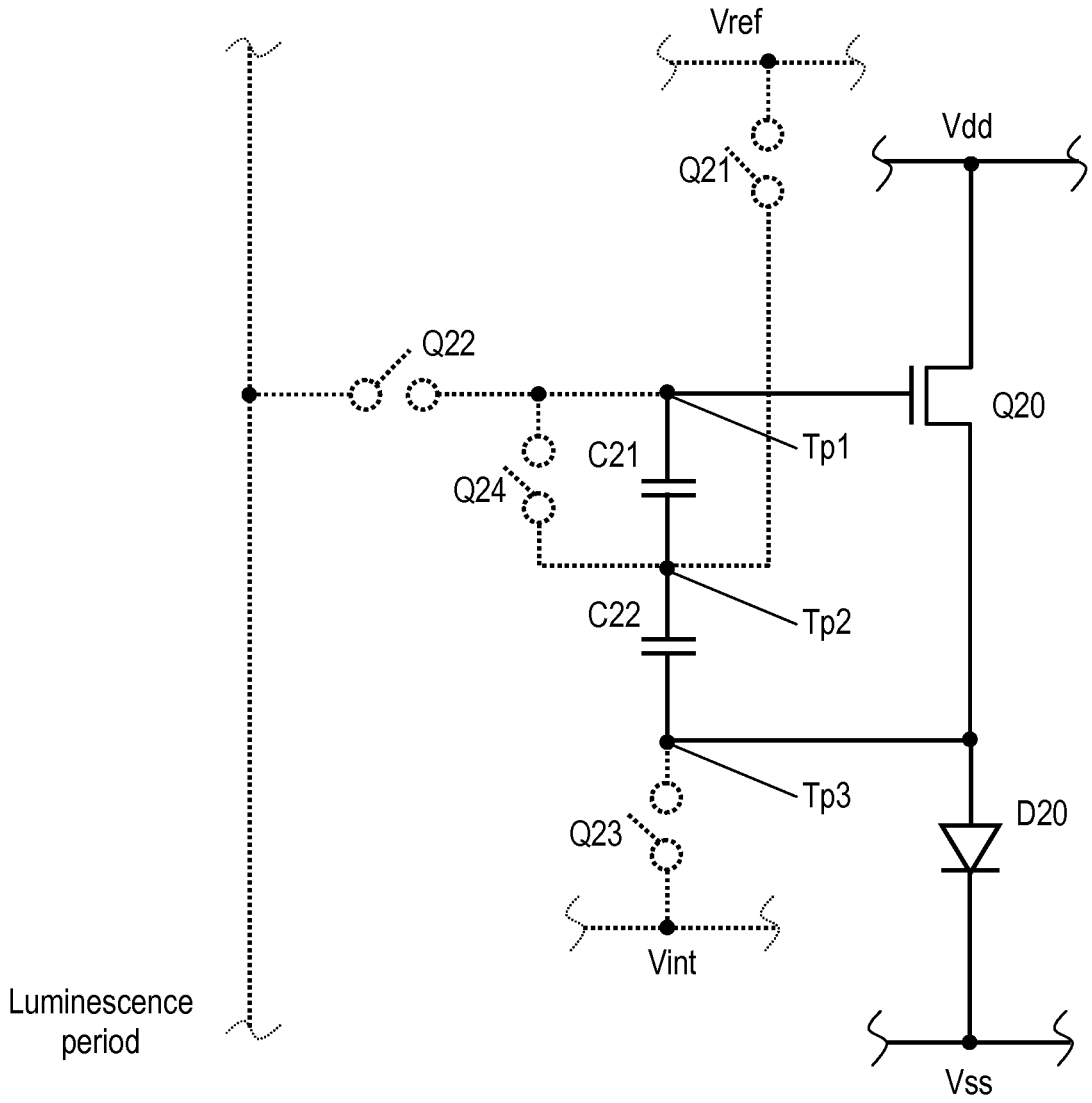
FIG. 8 is a circuit diagram for illustrating an operation of the pixel circuit during the luminescence period.

FIG. 8 is a circuit diagram for illustrating an operation of pixel circuit 12 (i, j) during luminescence period T4.

At time t4, control signal CNT22(i) is set to low level to set transistor Q22 OFF. Control signal CNT21(i) is set to low level to set transistor Q21 OFF. Consequently, nodes Tp1 to Tp3 temporarily enter a floating state and voltage (Vsg'+Vth), which is higher than threshold voltage Vth is applied between the gate and source of driving transistor Q20. Accordingly, a current corresponding to the G-S voltage of driving transistor Q20 is supplied to organic EL device D20.

At this point, the current (I) satisfies I=K*(VGS−Vth) =K*Vsg' (where, VGS is the G-S voltage, and K is a constant value), and is free from threshold voltage Vth.

As discussed above, current flowing in organic EL device D20 is not influenced by threshold voltage Vth. Therefore, the current flowing in organic EL device D20 is free from dispersion of threshold voltage Vth of driving transistor Q20. Further, even when threshold voltage Vth changes with the time, organic EL device D20 can emit light with luminosity corresponding to the image signal.

After luminescence period T4, non-light emitting period can be provided. This period can be achieved by turning ON one of the transistors Q21, Q23, and Q24.

In threshold detection period T2, it is desirable to turn transistor Q24 ON. However, if the leakage current of first capacitor C21 is negligible, transistor Q24 can be set to OFF. In this case, control signals CNT24 (i) and CNT23 (i) can be shared because the transistors Q23 and Q24 can be controlled by the same signal.

Second Embodiment

The structure of display device 10 in the second embodiment is similar to that of the first embodiment illustrated in FIG. 1. However, structure of pixel circuit 12 (i, j) differs from that of first embodiment.

Figure 9:
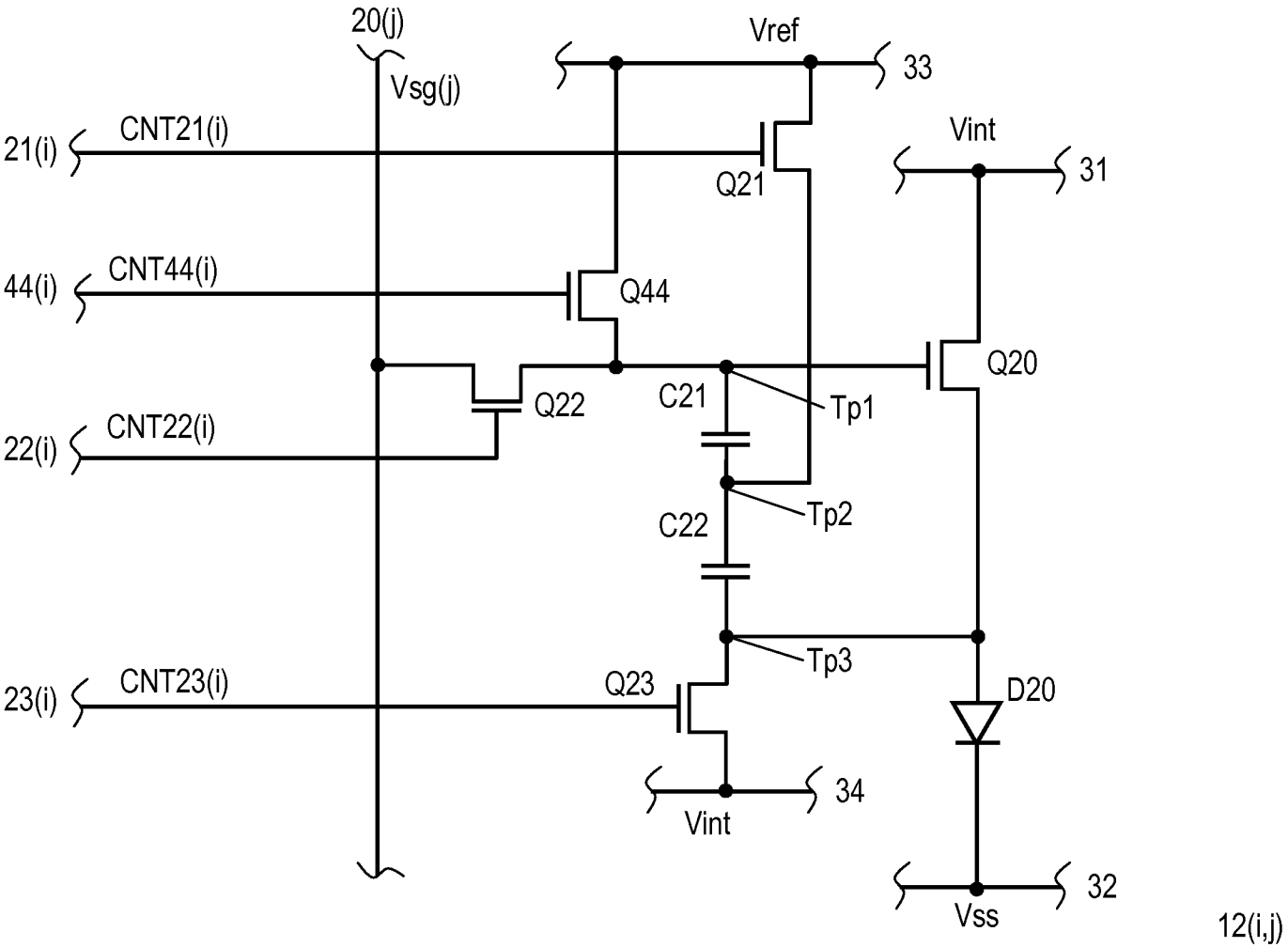
FIG. 9 is a circuit diagram of a pixel circuit of the display apparatus according to a second embodiment.

FIG. 9 is a circuit diagram of pixel circuit 12 (i, j) of display apparatus 10 according to the second embodiment. In the description of this embodiment, components which were described earlier in the first embodiment have the same reference numerals and may not be described in detail. Pixel circuit 12 (i, j) has organic EL device D20, driving transistor Q20, first capacitor C21, second capacitor C22, and transistors Q21 to Q23 which operate as switches.

However, in the second embodiment, transistor Q44, (fourth switch) which applies reference voltage Vref to a gate of driving transistor Q20, is provided instead of transistor Q24 (which short-circuits between node Tp2 and the gate of driving transistor Q20). A drain of transistor Q44 is connected to voltage line 33 which supplies reference voltage Vref, a source of transistor Q44 is connected to node Tp1, and the gate of transistor Q44 is connected to control signal line 44(i) which supplies control signal CNT44(i).

Next, an operation of pixel circuit 12 (i, j) in the second embodiment is described. Similarly to the first embodiment, one-frame period is divided into four periods (i.e. initialization period T1, threshold detection period T2, writing period T3, and luminescence period T4). The timing diagram of image signal voltage Vsg (j), control signals CNT21(i), CNT22(i), and CNT23 (i) are the same as those of first embodiment shown in FIG. 4. The timing diagram of control signal CNT44 (i) is same as control signal CNT24 (i) of the first embodiment shown in FIG. 4.

Initializing Period T1

At time t1, while control signal CNT22(i) is set to low level to set transistor Q22 OFF, control signals CNT44(i), CNT21 (i), and CNT23 (i) are set to high level to set transistors Q44, Q21, and Q23 ON. Reference voltage Vref is thereby applied to node Tp1 via transistor Q44 and to node Tp2 via transistor Q21. Initialization voltage Vint is applied to node Tp3 via transistor Q23.

Consequently, second capacitor C22 is charged to voltage (Vref−Vint) which is higher than threshold voltage Vth, similarly to the first embodiment. This leads to apply a voltage higher than threshold voltage Vth (i.e. Vref−Vint) between the gate and source of driving transistor Q20 so that the current corresponding to the G-S voltage is supplied from power line 31 to voltage line 34 via driving transistor Q20 and transistor Q23.

In this embodiment, initialization period T1 is also set to 1 micro second.

Threshold Detecting Period T2

At time t2, control signal CNT23(i) is set to low level to set transistor Q23 OFF. Second capacitor C22 is thus discharged, and voltage V22 falls toward threshold voltage Vth.

Similarly to the first embodiment, threshold detection period T2 is set to 10 micro seconds because a long time is required before the voltage V22 falls to threshold voltage Vth.

Writing Period T3

At time t3, control signal CNT44(i) is set to low level to set transistor Q44 OFF. Then, similarly to the first embodiment, control signal CNT22(i) is set to high level to set transistor Q22 ON. Voltage of node Tp1 then turns to image signal voltage Vsg (j), and terminal to terminal voltage of the first capacitor C21 turns to voltage (Vref−Vsg) which corresponds to image signal voltage Vsg'.

Writing period T3 is set to 1 micro second in this embodiment also.

Luminescence Period T4

The operation during luminescence period T4 is similar to that described in the first embodiment. At time t4, control signal CNT22(i) is set to low level to set transistor Q22 OFF, and control signal CNT21(i) is set to low level to set transistor Q21 OFF. As a result, voltage (Vsg'+Vth) is applied between the gate and sources of driving transistor Q20. This leads to supply current to organic EL device D20 having a current amount corresponding to the G-S voltage of driving transistor Q20.

As discussed above, transistor Q44 is provided as a switch for applying reference voltage Vref to node Tp1 instead of applying reference voltage Vref to node Tp1 via transistor Q24. This structure also allows preventing an adverse influence originated from the dispersion of threshold voltage Vth of driving transistor Q20. Further, even when threshold voltage Vth changes with the time, organic EL device D20 can emit light with luminosity corresponding to the image signal.

After luminescence period T4, a non-light emitting period can be provided. This period can be formed by turning ON one of the transistors Q21, Q23, and Q44.

In threshold detection period T2, it is desirable to turn transistor Q44 ON. However, transistor Q44 can be set to OFF if the leakage current of first capacitor C21 is negligibly small. In this case, control signals CNT44 (i) and CNT23 (i) can be shared because transistors Q23 and Q44 can be controlled by the same signal.

According to the second embodiment, reference voltage Vref is applied to node Tp1 via transistor Q44. However, voltage other than reference voltage Vref can be applied to node Tp1 via transistor Q44.

Third Embodiment

The structure of display device 10 in the third embodiment is similar to that of first embodiment illustrated in FIG. 1. However, structure of pixel circuit 12 (i, j) differs from that of first embodiment.

Figure 10:
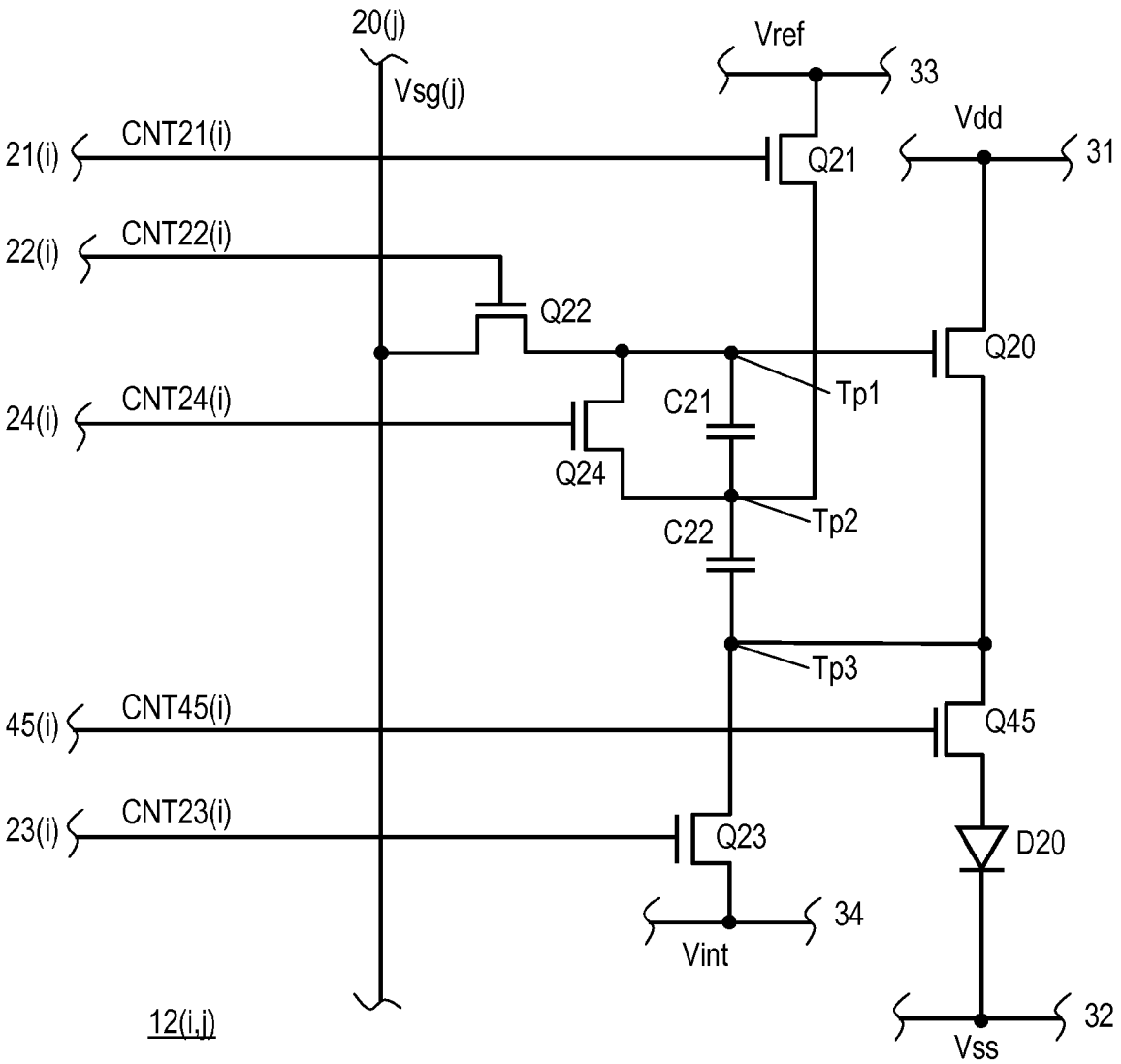
FIG. 10 is a circuit diagram of a pixel circuit of the display apparatus according to a third embodiment.

FIG. 10 is a circuit diagram of pixel circuit 12 (i, j) according to the third embodiment. In the description of this embodiment, components which were described earlier in the first embodiment have the same reference numerals and may not be described in detail. Pixel circuit 12 (i, j) has organic EL device D20, driving transistor Q20, first capacitor C21, second capacitor C22, and transistors Q21 to Q24 which operate as switches.

In the third embodiment, transistor Q45 (fifth switch) for cutting off the current in organic EL device D20 is further provided. To be specific, a drain of driving transistor Q20 is connected to power source line 31; a source of driving transistor Q20 is connected to a drain of transistor Q45; a source of transistor Q45 is connected to an anode of organic EL device D20; a cathode of organic EL device D20 is connected to power source line 32, and a gate of the transistor Q45 is connected with control signal line 45(i) which supplies control signal CNT45(i).

Next, an operation of pixel circuit 12 (i, j) according to the third embodiment is described.

Similarly to the first embodiment, one-frame period is divided into four periods (i.e. initialization period T1, threshold detection period T2, writing period T3, and luminescence period T4).

Figure 11:
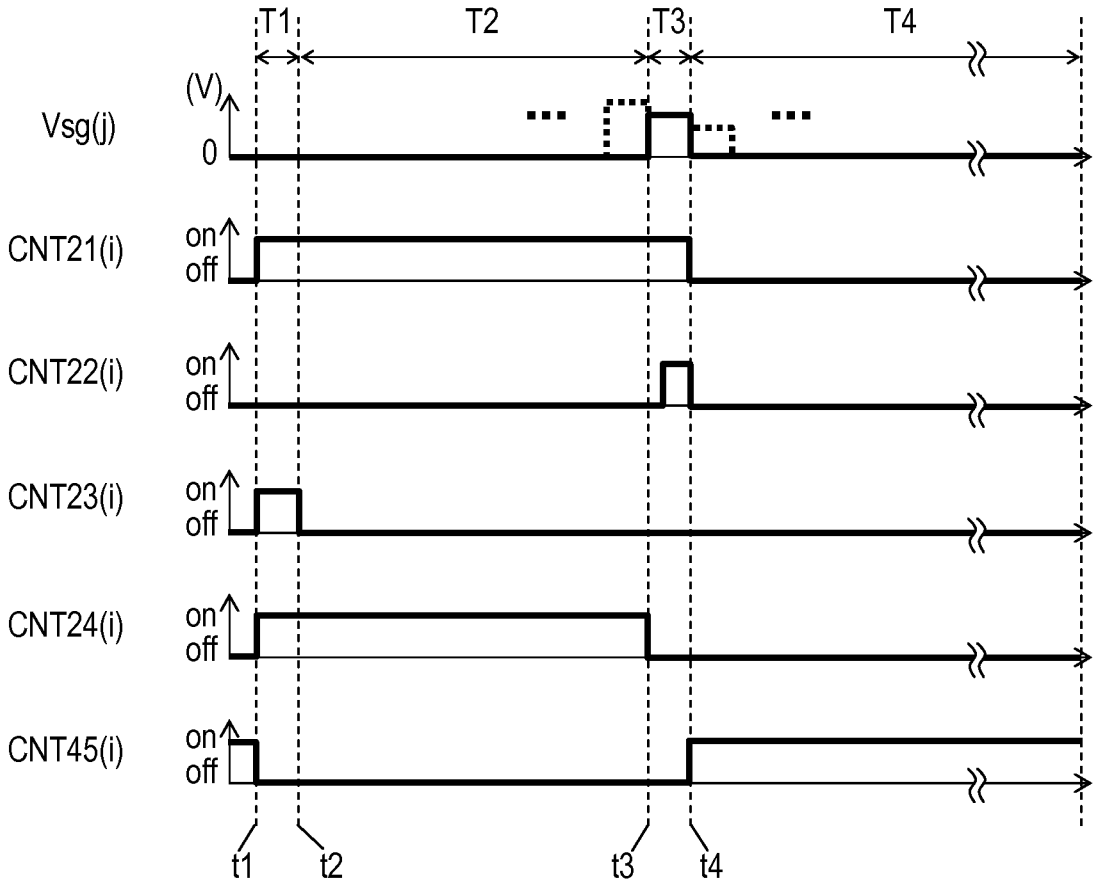
FIG. 11 is a timing diagram illustrating an operation of the pixel circuit.

FIG. 11 is a timing diagram illustrating an operation of pixel circuit 12 (i, j) according to the third embodiment. Image signal voltage Vsg (j), control signals CNT21(i) to CNT24(i) are similar to those in the first embodiment shown in FIG. 4.

Initialization Period T1

At time t1, control signal CNT45(i) is set to low level to set transistor Q45 OFF. Similarly to the first embodiment, control signal CNT22(i) is set to low level to set transistor Q22 OFF. Control signals CNT21(i), CNT23(i), and CNT24 (i) are set to high level to set transistors Q21, Q23, and Q24 ON. As a result, reference voltage Vref is applied to nodes Tp1 and Tp2. Initialization voltage Vint is applied to node Tp3.

Similarly to the first embodiment, the second capacitor C22 is thus charged to voltage (Vref−Vint) which is higher than threshold voltage Vth. Further, since transistor Q45 is OFF, current corresponding to the G-S voltage of driving transistor Q20 is supplied from power line 31 to voltage line 34 via driving transistor Q20 and transistor Q23.

In this embodiment, initialization period T1 is set to 1 micro second also.

Threshold Detecting Period T2

At time t2, control signal CNT23 (i) is set to low level to set transistor Q23 OFF. Similarly to the first embodiment, second capacitor C22 is thus discharged so that the voltage V22 decreases to threshold voltage Vth.

Similarly to foregoing embodiments, threshold detection period T2 is set to 10 micro seconds because a long time is required before the voltage V22 falls to threshold voltage Vth.

Writing Period T3

At time t3, control signal CNT24(i) is set to low level to set transistor Q24 OFF, and control signal CNT22(i) is set to high level to set transistor Q22 ON. As a result, voltage of node Tp1 turns to image signal voltage Vsg (j) and first capacitor C21 is charged to voltage (Vref−Vsg) which corresponds to image signal voltage Vsg'.

Writing period T3 is set to 1 micro second in this embodiment also.

Luminescence Period T4

At time t4, control signal CNT45 (i) is set to high level to set transistor Q45 ON. Then, similarly to the first embodiment, control signal CNT22(i) is set to low level to set transistor Q22 OFF. Control signal CNT21(i) is set to low level to set transistor Q21 OFF. As a result, voltage (Vsg'+Vth) is applied between the gate and sources of driving transistor Q20, and the current corresponding to the G-S voltage of driving transistor Q20 is supplied to organic EL device D20.

After the luminescence period T4, non-light emitting period can be provided. This period can be formed by turning transistor Q45 off. This period can be formed also by turning transistor Q23 ON after writing period T3, and then turning transistor Q45 OFF. In this case, the non-lighting period can be returned to light emitting period again by restoring transistor Q45 back to ON and then restoring transistor Q23 to OFF.

In the third embodiment, transistor Q45 (a switch for cutting off the current in organic EL device D20) is provided on a source side of driving transistor Q20. The adverse influence caused by the dispersion in threshold voltage Vth of driving transistor Q20 is thereby reduced. Further, even when threshold voltage Vth changes with the time, the organic EL device D20 can emit light with luminosity corresponding to image signal.

Further, in the structure of the third embodiment, reference voltage Vref can be set larger than a sum of low-voltage Vss and voltage Vled of organic EL device D20 because current in organic EL device D20 can be cut off by setting transistor Q45 OFF. For example, in this embodiment, high-voltage Vdd is 10(V), low-voltage Vss is 0(V), reference voltage Vref is 2(V), and initialization voltage Vint is 0(V). By setting each of the voltages as above, both of voltages Vss and Vint can be set to a ground voltage. Further, each of the voltages applied to pixel circuit 12 (i, j) can be a positive value or 0 (V).

In threshold detection period T2, it is desirable to set transistor Q24 ON. However, if the leakage current of first capacitor C21 is negligibly small, transistor Q24 can be set to OFF. In this case, control signals CNT24(i) and CNT23(i) can be shared.

Fourth Embodiment

The structure of display device 10 in the fourth embodiment is similar to that of first embodiment illustrated in FIG. 1. However, structure of pixel circuit 12 (i, j) differs from that of the first embodiment.

Figure 12:
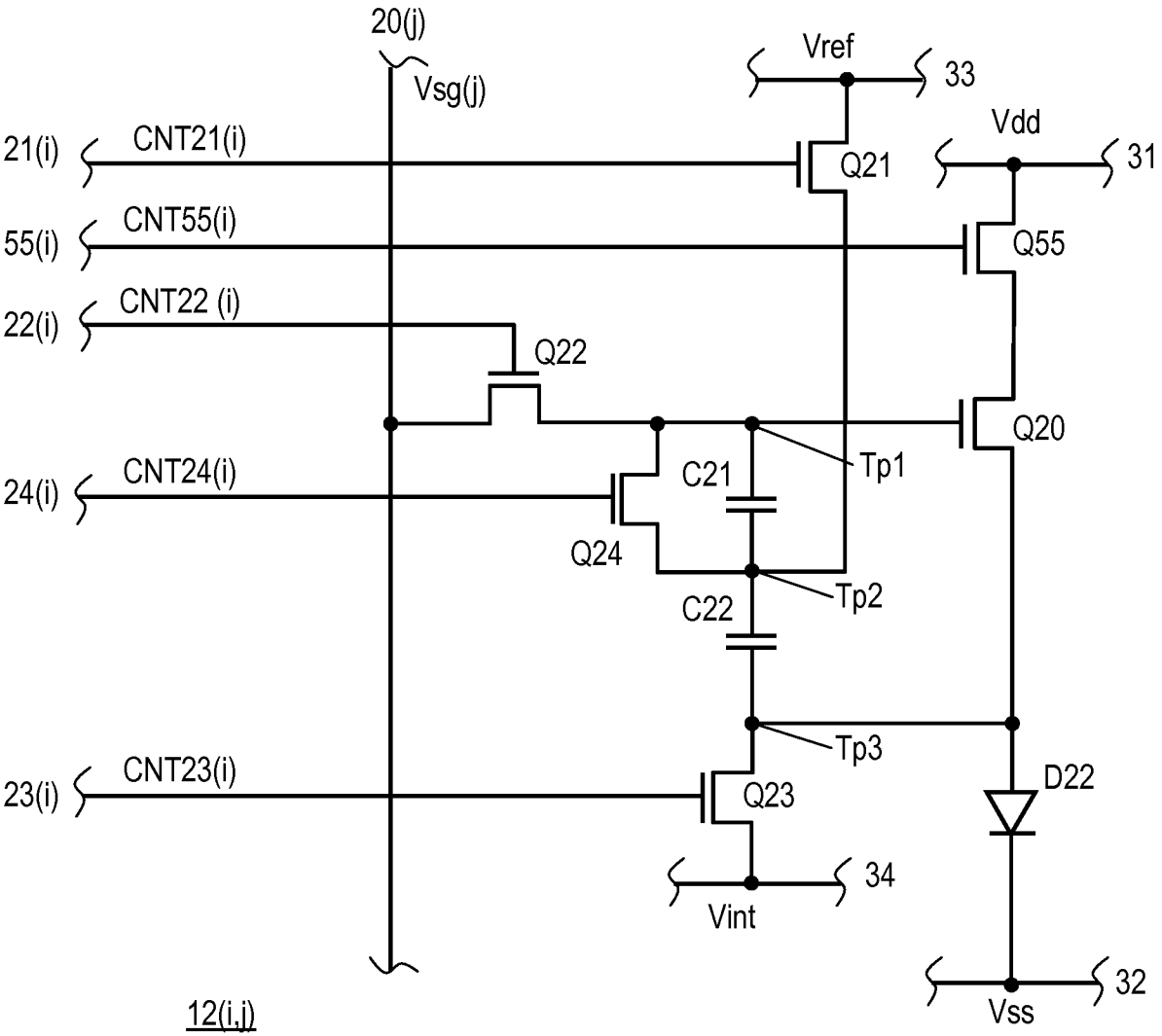
FIG. 12 is a circuit diagram of a pixel circuit of the display apparatus according to a fourth embodiment.

FIG. 12 is a circuit diagram of pixel circuit 12 (i, j) of display apparatus 10 according to the fourth embodiment. In the description of this embodiment, components which were described earlier in the first embodiment have the same reference numerals and may not be described in detail. As described in the first embodiment, pixel circuit 12 (i, j) of the present embodiment also has organic EL device D20, driving transistor Q20, first capacitor C21, second capacitor C22, and transistors Q21 to Q24 which operate as switches.

In the fourth embodiment, transistor Q55, which is a fifth switch for cutting off the current, is further provided between the drain of transistor Q20 and the power supply of voltage Vdd in order to supply current to organic EL device 20. A drain of driving transistor Q55 is connected to power source line 31; a source of driving transistor Q55 is connected to the drain of driving transistor Q20; a source of driving transistor Q20 is connected to an anode of organic EL device D20; and a cathode of organic EL device D20 is connected to power source line 32, and a gate of transistor Q55 is connected to control signal line 55(i) which supplies control signal CNT 55 (i).

Next, an operation of pixel circuit 12 (i, j) according to the fourth embodiment is described.

Similarly to the first embodiment, one-frame period is divided into four periods, (i.e. initialization period T1, threshold detection period T2, writing period T3, and luminescence period T4).

Figure 13:
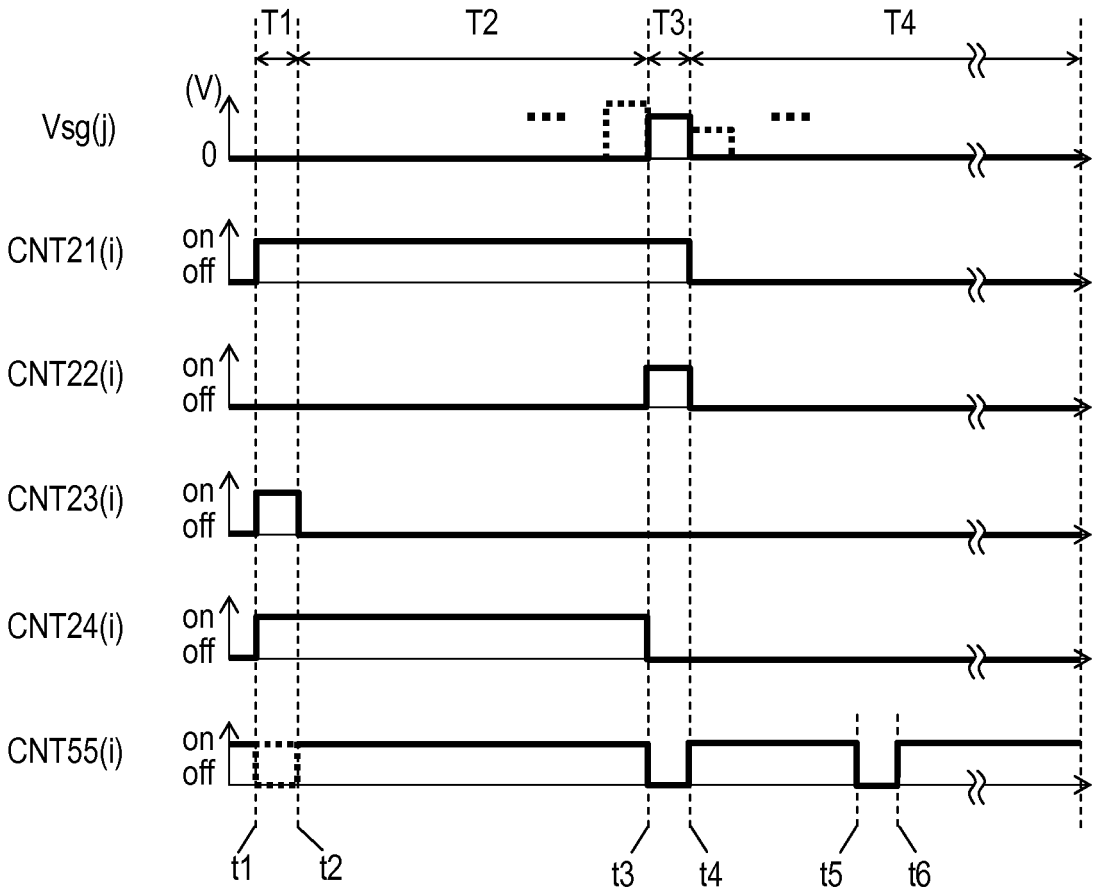
FIG. 13 is a timing diagram illustrating an operation of the pixel circuit.

FIG. 13 is a timing diagram illustrating an operation of pixel circuit 12 (i, j) according to the fourth embodiment. The timing diagram of image signal voltage Vsg (j), control signals CNT21 (i) to CNT24 (i) are the same as those of the first embodiment shown in FIG. 4.

Initialization Period T1

Similarly to the first embodiment, at time t1, control signal CNT22(i) is set to low level to set transistor Q22 OFF. Control signals CNT22(i), CNT23(i), and CNT24(i) are set to high level to set transistors Q21, Q23, and Q24 ON. Control signal CNT55(i) can be either low level or high level. Reference voltage Vref is thereby applied to nodes Tp1 and Tp2. Initialization voltage Vint is applied to node Tp3.

Similarly to the first embodiment, voltage (Vref−Vint), which is higher than threshold voltage Vth, is charged to second capacitors C22. In this case, the current corresponding to the G-S voltage of driving transistor Q20 is supplied from power supply line 31 to voltage line 34 via transistor Q55, driving transistor Q20, and transistor Q23 by setting transistor Q55 ON.

In this embodiment, initialization period T1 is set to 1 micro second also.

Threshold Detection Period T2

At time t2, control signal CNT55 (i) is set to high level to set transistor Q55 ON, and control signal CNT23(i) is set to low level to set transistor Q23 OFF. As a result, current flows in driving transistor Q20 because the voltage V22 is applied between the gate and source of driving transistor Q20. Second capacitor C22 is then discharged by this current, and voltage V22 decreases toward threshold voltage Vth.

Threshold detection period T2 is set to 10 micro seconds also in the fourth embodiment because a long time is required before the voltage V22 falls to threshold voltage Vth.

Writing Period T3

At time t3, control signal CNT55(i) is set low level to set transistor Q55 OFF. Control signal CNT24(i) is set low level to set transistor Q24 OFF. Further, control signal CNT22(i) is set to high level to set transistor Q22 ON. As a result, voltage of node Tp1 turns to image signal voltage Vsg (j) and voltage (Vref−Vsg) (which corresponds to image signal voltage Vsg') is charged to first capacitor C21.

In this case, when image signal voltage Vsg' is larger than zero, the voltage larger than threshold voltage Vth is applied between the gate and source of driving transistor Q20. However, current does not flow in driving transistor Q20 because transistor Q55 is OFF and voltage V22 thereby does not change. Threshold voltage Vth of driving transistor Q20 is compensated accurately because the voltage V22 (i.e. voltage charged in second capacitor C22) is maintained to the threshold voltage Vth which is fixed in threshold detecting period T2.

Luminescence Period T4

At time t4, control signal CNT55 (i) is set to high level to set transistor Q55 ON. Thereafter, control signal CNT22 (i) is set to low level to set transistor Q22 OFF and control signal CNT21 (i) set to low level to set transistor Q21 OFF similarly to the first embodiment. Voltage (Vsg'+Vth), which is larger than threshold voltage Vth, is thereby applied between the gate and source of driving transistor Q20. Thus, the current corresponding to the G-S voltage of driving transistor Q20 is supplied to organic EL device D20.

In the fourth embodiment, a non-light emitting period can be set as necessary having an adequate length at an adequate timing after writing period T3. In order to set the non-light emitting period, at time t5, control signal CNT55(i) is set to low level to set transistor Q55 OFF. This stops organic EL device D20 from emitting light because the current does not flow into driving transistor Q20. During the non-light emitting period, a current path for discharging first capacitor C21 and second capacitor C22 is cut off so that the amounts of voltages V21 and V22 are maintained. At time T6, the non-light emitting period returns to light emitting period T4 by setting control signal CNT55(i) high level and turning transistor Q55 ON.

As discussed above, in the fourth embodiment, transistor Q55 (a switch for cutting off the current flowing into organic EL device D20) is provided in the drain side of driving transistor Q20. This structure can also reduce an adverse influence caused by the dispersion of threshold voltage Vth of driving transistor Q20. Further, even when threshold voltage Vth changes with the time, organic EL device D20 can emit light properly with luminosity corresponding to image signal.

In threshold detecting period T2, it is desirable to set transistor Q24 ON. However, if leakage current of the first capacitor C21 is negligibly small, transistor Q24 can be set to OFF. In this case, control signals CNT24(i) and CNT23(i) can be shared.

Transistor Q55 in the fourth embodiment is an N-channel TFT; however, transistor Q55 can be formed by a P-channel TFT instead. Generally, P-channel TFT can make "ON resistance" small when voltage is high. This lowers power consumption of transistor Q55. In this context, "ON resistance" means resistance between the drain and source electrodes of transistor when transistor is ON.

According to the fourth embodiment, transistors Q55 are provided for each of pixel circuits 12 (i, j) independently. Instead, one transistor Q55 can be provided commonly for multiple pixel circuits 12 (i, j). For example, one transistor Q55 can be provided for every pixel rows (i.e. pixel circuits 12 (i, 1)-12 (i, m)) or can be provided for every multiple pixel rows.

Each of the numerical values such as voltages in the first to fourth embodiments are examples. These values may be set optimally based on characteristics of organic EL device or specification of the display apparatus.

INDUSTRIAL APPLICABILITY

The present disclosure is useful for an active-matrix display apparatus employing a current light emitting device.

The invention claimed is:

1. A display apparatus having a plurality of arrayed pixel circuits, each of the pixel circuits comprising:

a current light emitting device;

a driving transistor supplying current to the current light emitting device;

a first capacitor having a first terminal connected with a gate of the driving transistor;

a second capacitor connected between a second terminal of the first capacitor and a source of the driving transistor;

a first switch applying a reference voltage to a node at which the first capacitor and the second capacitor are connected;

a second switch supplying an image signal voltage to the gate of the driving transistor;

a third switch supplying an initialization voltage to the source of the driving transistor, and a fourth switch applying the reference voltage to the gate of the driving transistor, the fourth switch having a first terminal directly connected to a voltage line applied with the reference voltage and a second terminal connected to the gate of the driving transistor, wherein the each of the pixel circuits is driven to have an initialization period, a threshold detecting period, a writing period, and a luminescence period, the initialization period being a period in which the second capacitor is charged to a predetermined voltage, the threshold detecting period being a period in which a threshold voltage of the driving transistor is detected by only the second capacitor after the initialization period, the writing period being a period in which the image signal voltage is supplied to only the first capacitor after the threshold detecting period, and the luminescence period being a period in which the current light emitting device is caused to emit light after the writing period.

2. The display apparatus of claim 1, further comprising:

a fifth switch configured to cut off a current flow between the source of the driving transistor and the current light emitting device.

3. The display apparatus of claim 1, further comprising:

a fifth switch configured to cut off a current flow between a drain of the driving transistor and a power supply supplying current to the current light emitting device.

4. The display apparatus of claim 1, wherein a third control signal and a fourth control signal are shared, the third control signal being for performing control to set the third switch to ON and OFF, and the fourth control signal being for performing control to set the fourth switch to ON and OFF.

5. The display apparatus of claim 1, wherein a second control signal and a third control signal are not shared, the second control signal being for performing control to set the second switch to ON and OFF, and the third control signal being for performing control to set the third switch to ON and OFF.

6. The display apparatus of claim 1, wherein in the threshold detecting period, the third switch is OFF while the reference voltage is applied to a point at which the gate of the driving transistor and the first capacitor are connected and the node at which the first capacitor and the second capacitor are connected.

7. The display apparatus of claim 1, wherein in the writing period, the first switch and the second switch are ON and the third switch and the fourth switch are OFF.

8. The display apparatus of claim 1, wherein in the luminescence period, the first switch, the second switch, the third switch, and the fourth switch are all OFF.

9. A display apparatus having a plurality of arrayed pixel circuits, each of the pixel circuits comprising:

a current light emitting device;

a driving transistor supplying current to the current light emitting device;

a first capacitor having a first terminal connected with a gate of the driving transistor;

a second capacitor connected between a second terminal of the first capacitor and a source of the driving transistor;

a first switch applying a reference voltage to a node at which the first capacitor and the second capacitor are connected;

a second switch supplying an image signal voltage to the gate of the driving transistor;

a third switch supplying an initialization voltage to the source of the driving transistor, and a fourth switch configured to short circuit the node of the first and second capacitor and the gate of the driving transistor, wherein the each of the pixel circuits is driven to have an initialization period, a threshold detecting period, a writing period, and a luminescence period, the initialization period being a period in which the second capacitor is charged to a predetermined voltage, the threshold detecting period being a period in which a threshold voltage of the driving transistor is detected by only the second capacitor after the initialization period, the writing period being a period in which the image signal voltage is supplied to only the first capacitor after the threshold detecting period, and the luminescence period being a period in which the current light emitting device is caused to emit light after the writing period.

10. The display apparatus of claim 9, further comprising:

a fifth switch configured to cut off a current flow between the source of the driving transistor and the current light emitting device.

11. A display apparatus of claim 9, further comprising:

a fifth switch configured to cut off a current flow between a drain of the driving transistor and a power supply supplying current to the current light emitting device.

12. The display apparatus of claim 9, wherein a third control signal and a fourth control signal are shared, the third control signal being for performing control to set the third switch to ON and OFF, and the fourth control signal being for performing control to set the fourth switch to ON and OFF.

13. The display apparatus of claim 9, wherein a second control signal and a third control signal are not shared, the second control signal being for performing control to set the second switch to ON and OFF, and the third control signal being for performing control to set the third switch to ON and OFF.

14. The display apparatus of claim 9, wherein in the threshold detecting period, the third switch is OFF while the reference voltage is applied to a point at which the gate of the driving transistor and the first capacitor are connected and the node at which the first capacitor and the second capacitor are connected.

15. The display apparatus of claim 9, wherein in the writing period, the first switch and the second switch are ON and the third switch and the fourth switch are OFF.

16. The display apparatus of claim 9, wherein in the luminescence period, the first switch, the second switch, the third switch, and the fourth switch are all OFF.

* * * * *